US005488968A

United States Patent [19]

Price et al.

[11] Patent Number: 5,488,968

[45] Date of Patent: Feb. 6, 1996

[54] FLUIDIZING SYSTEM AND METHOD

[76] Inventors: John R. Price, 525 Odum Rd., Hubert, N.C. 28539; Michael A. Way, 207 Gooding Rd., Beaufort, N.C. 28516

[21] Appl. No.: 447,723

[22] Filed: May 23, 1995

[51] Int. Cl.[6] ..... E03B 5/00; E03B 7/12

[52] U.S. Cl. ..... 137/1; 137/59; 137/334; 137/565; 138/34; 237/80

[58] Field of Search ..... 137/1, 2, 59, 62, 137/301, 334, 337, 565, 859; 138/34; 237/80

[56] References Cited

U.S. PATENT DOCUMENTS

| | | | |
|---|---|---|---|
| 2,172,882 | 9/1939 | Watkins | 138/34 |
| 2,670,082 | 2/1954 | Dunn et al. | 138/34 |
| 3,346,191 | 10/1967 | Roach | 137/59 |
| 3,384,123 | 5/1968 | Saddison | 138/34 |
| 3,420,252 | 1/1969 | Stroble | 137/59 |
| 3,929,154 | 12/1975 | Goodwin | 137/344 |
| 4,286,617 | 9/1981 | Bedient | 137/334 |
| 4,298,021 | 11/1981 | Bozeman | 137/334 |
| 4,355,652 | 10/1982 | Perkins | 137/15 |
| 4,531,538 | 7/1985 | Sandt et al. | 137/334 |
| 5,318,059 | 6/1994 | Lyons | 137/62 |
| 5,337,774 | 8/1994 | Boyd | 137/1 |

*Primary Examiner*—George L. Walton
*Attorney, Agent, or Firm*—Richard E. Jenkins

[57] ABSTRACT

A fluidizing apparatus, such as a winterizing apparatus, and related method for preventing freezing of water in the water pipes of a dwelling. The apparatus includes a pump, an inlet line, an outlet line, a pressure switch, and an air compressor tank. The outlet line is connected to a faucet of the water pipes of the dwelling and the inlet line is positioned in a container of fluid, such as antifreeze. When a second faucet is opened, the pump is activated, and the pump will then cause antifreeze to flow from the container, through the inlet line, the pump, and the outlet line, and then into the faucet and through the water pipes of the dwelling. An associated air compressor tank is in fluid communication with the pressure switch and exit line, and cooperates with the pressure switch to maintain consistent pumping of the antifreeze. After antifreeze is in the pipes, a shut-off valve in the exit line is closed and/or the at least one valved water outlet is closed, which causes the pump to deactivate.

20 Claims, 1 Drawing Sheet

FLUIDIZING SYSTEM AND METHOD

TECHNICAL FIELD

The present invention relates, in general, to the prevention of water pipe freeze-up in a dwelling. More particularly, the present invention relates to a fluidizing apparatus, preferably a winterizing apparatus, and related method for introducing antifreeze, or optionally other fluids such as sanitizers/cleaners, into the pipes of a dwelling in a simple manner wherein it is unnecessary first to drain the water from the pipes inside the dwelling.

RELATED ART

Always, a problem exists with relation to winterizing a dwelling that is not to be occupied for a period of time during the cold, winter months. This problem arises, for instance, in connection with a residence or business in a summer time vacation area, for which residence or business it is desired not to have any heating during the winter when the occupants are away.

While the plumbing pipes of such dwellings can be drained, it is often very difficult, if not impossible, to remove all of the water from the plumbing pipes, toilets, drain traps, clothes washing machines, dishwashers, ice makers, hot tubs, jacuzzis, hot water heaters, et cetera. Thus, the water that is retained can cause cracking or other damage to the pipes or fixtures, such as tubs and sinks, in which the water is trapped.

It is well known that a customary method of obviating this problem of trapped water is to fill the hot water heater tank of the dwelling with antifreeze and allow the antifreeze to travel therefrom throughout the pipes. The drawback of this customary method is that antifreeze is expensive and filling the hot water heater tank requires a substantial amount of antifreeze. As a result, other apparatus and methods have been developed for winterizing.

One such apparatus is depicted in U.S. Pat. No. 5,318,059 to Lyons. This apparatus separates out a portion of the cold water delivered to a dwelling house and runs the cold water through a heat exchanger in a hot water tank. Then, the resultant warmed water is allowed to flow through a cold water main of the dwelling when an outlet is automatically and periodically opened by a temperature-sensing valve. Consequently, the cold water flowing through the cold water main warms the water in all branch lines throughout the dwelling, as well as in the outlet, in order to prevent freezing of the branch lines.

Also, of interest is the apparatus illustrated in U.S. Pat. No. 3,929,154 to Goodwin. This apparatus includes a tank of antifreeze connected by a pump-containing pipe to the cold water valve of a recreational vehicle's water storage tank, and operates in combination with the water conduits of the recreational vehicle to winterize it.

Another apparatus of interest is that shown in U.S. Pat. No. 3,384,123 to Saddison for introducing antifreeze into the water conduits of a self-service car wash in order to prevent freezing of the car wash. The apparatus includes an air compressor directly connected to a tank of antifreeze so that the upper portion of the tank is filled with gas under pressure in order to force antifreeze out of the tank and into the conduits. In an alternative embodiment, the antifreeze is supplied from the tank to an aspirator, and compressed gas is supplied from the air compressor tank to a nozzle in the aspirator so that the gas causes droplets of antifreeze to be aspirated into the conduits.

SUMMARY AND OBJECTS OF THE INVENTION

Accordingly, the present invention provides a fluidizing apparatus, preferably a winterizing apparatus, in combination with a water pipe assemblage of a dwelling. The pipe assemblage has (i) a valved water supply line for supplying water into the dwelling, (ii) a water main line disposed in the dwelling and hydraulically connected to receive water from the water supply line, and (iii) a plurality of valved water outlets hydraulically connected with the water main. The apparatus comprises a pump, an inlet line, an outlet line, a pressure switch, and an air compressor tank. The inlet line is adapted for providing fluid, such as antifreeze, from a source thereof to the pump, whereas the outlet line is adapted for providing the fluid, such as antifreeze, from the pump by way of at least one valved water outlet into the main water line. Additionally, the pressure switch is in fluid communication with the outlet line and adapted to deactivate the pump when the outlet line is connected to the at least one valved water outlet and fluid flow through the outlet line is stopped by closure thereof. Moreover, the air compressor tank contains compressed air and is in fluid communication with the pressure switch and the outlet line. Also, the tank is adapted to cooperate with the pressure switch to maintain consistent pumping of the fluid, such as antifreeze, by the pump into the main water line, when the valved water supply line is closed, the at least one valved water outlet to which the outlet line is connected is open, and at least a first of all the other valved water outlets is open.

Furthermore, the present invention provides a method for providing fluid to, including preventing freezing of water in, a water pipe assemblage of a dwelling. The method comprises providing, in combination, a fluidizing apparatus, preferably a winterizing apparatus, with a water pipe assemblage of a dwelling, as described in the paragraph above. The inlet line of the apparatus is placed in the fluid, such as antifreeze, at some point in the method prior to pumping. The method further comprises shutting off the valved water supply line, followed by connecting the outlet line to the at least one valved water outlet. Next, the method comprises opening the at least one valved water outlet, followed by opening all other valved water outlets, desirably in a sequential manner as described below, to allow water to flow therefrom. Opening a first of another valved water outlet activates the pressure switch to cause the pump to pump the fluid, such as antifreeze, through the at least one valved water outlet to which the outlet line is connected and into the main water line until the fluid, such as antifreeze, flows from the first other opened valved water outlet (and any other optionally opened valved water outlets). Lastly, the method comprises closing the outlet line (i.e., closing the other open valved water outlet) to deactivate the pump, and disconnecting the outlet line from the at least one valved water outlet to which it is connected.

Preferably in the method, all the other valved water outlets are opened sequentially one at a time. More particularly, a first one of the other valved outlets is opened until antifreeze flows therefrom, and then shut, which turns off the pump. Then, the next of the other valved outlets is opened, which re-starts the pump, until antifreeze flows therefrom and then shut, which shuts off the pump. The opening and closing is repeated for all remaining valved outlets.

Hence, it is an object of the present invention to provide an apparatus and related method wherein it is not required first to drain the water from the lines of a dwelling and then pump fluid, such as antifreeze, therein.

It is an advantage of the present invention that the apparatus and related method are simple in that the apparatus may be easily connected to a valved water outlet in the dwelling and the pump activated to pump fluid, such as antifreeze, into lines of the dwelling.

Some of the objects and advantages of the invention having been stated above, other objects, as well as other advantages, will become evident as the description proceeds, when taken in conjunction with the accompanying drawing as best described below.

DETAILED DESCRIPTION AND BEST MODE FOR CARRYING OUT THE INVENTION

Figure 1:
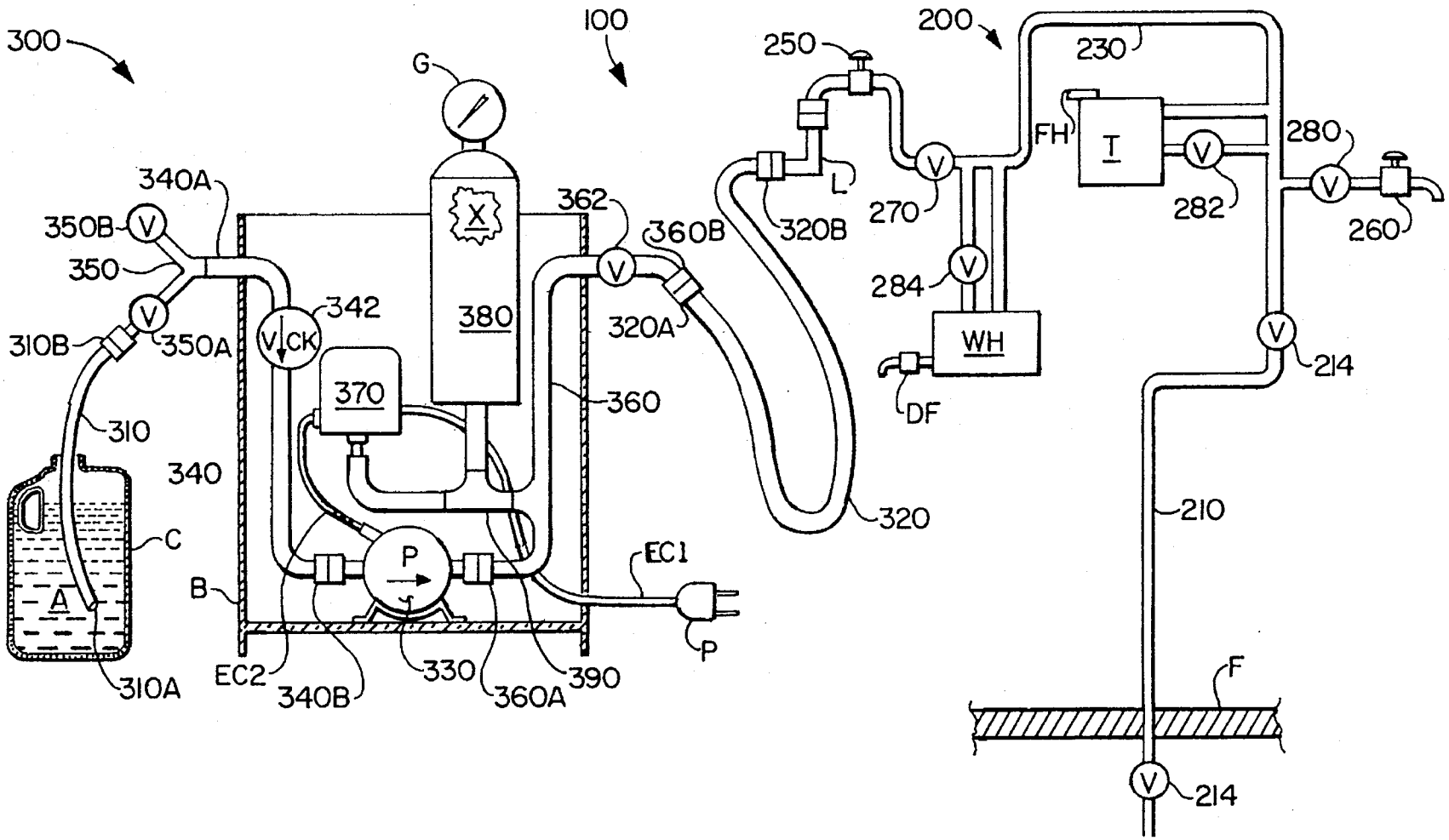
FIG. 1 is a schematic view of the inventive winterizing apparatus and associated water lines in a dwelling.

Depicted schematically in FIG. 1 is fluidizing system 100, which comprises in combination water pipe assemblage 200 of a dwelling (not illustrated), such as a residence house, a trailer home, a store, et cetera, and fluidizing apparatus 300. Water pipe assemblage 200 and fluidizing apparatus 300 are connected to each other as follows.

Water pipe assemblage 200 includes water supply line 210 that passes through wall or floor F of the dwelling for supplying water thereto, for instance from a well or municipal facility (not illustrated), and that is provided with one or more shut-off valves 212 and 214. Water pipe assemblage 200 further includes main water line 230 hydraulically connected to water supply line 210. It is to be understood that in a typical dwelling, main water line 220 is made up of various branch water lines, which are not illustrated in the drawing for convenience.

More particularly, supply line 210 feeds water to and is hydraulically connected to main line 230 in the dwelling for supplying water to toilets T, hot water heaters WH, tubs (not illustrated), sinks (not illustrated), et cetera. Shut-off valve 212 may be closed to stop the flow of water from outside the house through supply line 210 into main line 230.

Additionally, portions of main line 230 may be closed by one or more of a plurality of valved water outlets hydraulically connected therewith, illustrated as conventional faucets 250 and 260, such as a kitchen sink faucet, an outside water faucet, a tub faucet, a shower head, et cetera. By the term "valved water outlets" it is intended to include a button or a flush handle FH, such as that conventionally provided on a toilet fixture T, or a drain faucet DF for a hot water heater fixture WH. Furthermore, feeding of water from main line 230 to faucets 250 and 260 may be stopped by optionally provided shut-off valves 270 and 280 associated with faucets 250 and 260, respectively, shut-off valve 282 associated with toilet T, and shut-off valve 284 associated with water heater WH. Although not illustrated in the drawing, it is intended that by the term "shut-off valves" included are shut-off valves for ice makers, hot tubs, dishwashers, et cetera.

Fluidizing apparatus 300 includes various components, which, as shown in the drawing, may generally be contained in housing B for convenience and portability of fluidizing apparatus 300. One such component is inlet hose 310 having a first end 310A and a second end 310B, with first end 310A being adapted to be positioned in fluid A, contained in container C. Preferably, fluidizing apparatus 300 is a winterizing apparatus and fluid A is antifreeze.

However, it is intended that apparatus 300 may be employed to pump fluids A other than antifreeze into the dwelling, such as sanitizers/cleaners, for instance the KAY brand sanitizer available from Kay Chemical Company. However, the description proceeds below in connection with the invention as it relates to the preferred embodiment employing antifreeze.

Suitable antifreeze A may be purchased under the trade name RV ANTI-FREEZE, which is a non-toxic, non-injurious antifreeze having a red color and available from Ace Hardware Corporation of Oak Brook, Ill. Traditional antifreeze, ethylene glycol, should not be used, as it is highly poisonous to humans and animals.

Apparatus 300 also includes outlet hose 320 having first end 320A and second end 320B, with second end 320B being adapted to be connected to at least one of the valved faucets, suitably illustrated in the drawing as being connected to valved faucet 250. Connector end 320B, as well as all other ends adapted for connection as described below, may be press fit or have screw threads, as is well known to those skilled in the art.

Preferably, the connection of second end 320B and valved faucet 250 is achieved with L-shaped connector L that allows second end 320B to be connected horizontally instead of vertically as it would have to be for direct connection to faucet 250 since faucets are conventionally oriented vertically downwards for exodus of water therefrom.

Another component of apparatus 300 is pump 330. A representative pump 330 may be purchased under the trade name LITTLE GIANT from Tecumseh Products Company of Oklahoma City, Okla., and is suitable for pumping a flow of 4 gallons of water per minute. Pump 330 may be AC or DC.

Moreover, apparatus 300 includes entrance conduit 340 having first end 340A and second end 340B. Check valve 342 is disposed between first and second ends 340A and 340B of entrance conduit 340, and entrance conduit 340 is connected at second end 340B to pump 330. Check valve 342 may be closed when container C is empty of antifreeze A so that pump 330 does not draw air.

Associated with pump 330 and preferably included in apparatus 300 is intake manifold 350. A representative intake manifold 350 is available under the trade name ACE Part No. 71463 Y-Connector from Ace Hardware Company of Oak Brook, Ill. Intake manifold 350 connects inlet hose second end 310B and entrance conduit first end 340A. Intake manifold 350 is conveniently Y-shaped with first valve 350A at the end of one arm of the Y and second valve 350B at the end of the other arm of the Y, and is shown connected only to one inlet hose 310 at first valve 350A so that second valve 350B is closed. However, for faster flow of antifreeze into main line 230, second valve 350B may be open and connected to a second inlet hose disposed in a second container of antifreeze (not illustrated).

Additionally, apparatus 300 includes exit conduit 360 having first end 360A and second end 360B, with shut-off valve 362 disposed at second end 360B. Exit conduit 360 is connected at first end 360A to pump 330 and at second end 360B to outlet hose first end 320A.

Also, apparatus 300 includes pressure switch 370 in fluid communication with exit conduit 360. Pressure switch 370 has electric cord EC1 ending in male plug P for electrical connection via electric cord EC1 to a female electrical outlet (not illustrated) in the dwelling and has electric cord EC2 for electrical connection to pump 360.

A representative pressure switch 370, available under the trade name PUMP TROL SQUARE D 2040 pressure switch, may be purchased from SQUARE D Company. Pressure switch 370 is adapted to deactivate pump 330 when outlet hose second end 320B is connected to valved water outlet 250 and fluid flow through outlet hose 320 is stopped by closure of shut-off valve 362 disposed in exit conduit 360, closure of faucet 250, closure of shut-off valve 270, closure of faucet 260, et cetera.

Finally, apparatus 300 includes air compressor tank 380. Tank 380 contains compressed air X therein and is in fluid communication with pressure switch 370 and exit conduit 360. Preferably, the fluid communication is achieved via inverted T-shaped connector hose 390, with the vertical bar of the T leading to tank 380 and each of the two ends of the horizontal cross bar of the T leading to pressure switch 370 and exit conduit 360, respectively.

Tank 380 cooperates with pressure switch 370 to maintain consistent pumping of antifreeze A by pump 330 from container C into main water line 230 of the dwelling. A representative air tank 380 is a 1½ inch×¾ inch air chamber (gauge optional) available from Sue Chief Manufacturing Company of Peculiar, Mo.

In order to operate winterizing apparatus 300 of the present invention, it is unnecessary, in contrast to prior art apparatus and related methods, first to drain the water from the water pipes of the dwelling prior to pumping fluid A, such as antifreeze A, and thus water may remain in pipe assemblage 200.

More particularly, for the method of the present invention, a shut-off valve of supply line 210, such as valve 212 is closed, and second end 320B of outlet hose 320 is connected to a valved outlet, suitably faucet 250 as illustrated in the drawing.

It is noted that a conventional faucet has its exit port oriented vertically downwards to allow for the exodus of water from the faucet. Accordingly, it is preferable to connect second end 320B to faucet 250 by using L-shaped connector L, as illustrated in the drawing, which allows for second end 320B of outlet hose 320 to be oriented in a horizontal direction for making the connection to faucet 250 more convenient. Otherwise, second end 320B would have to be oriented in a vertically upwards direction to be connected to faucet 250, which would be inconvenient since faucet 250 would be disposed over a sink or tub (not illustrated).

Next, first end 310A of inlet hose 310 is placed in antifreeze A in container C, followed by opening faucet 250 and then opening at least a first, or optionally more than the first, of all other faucets in the dwelling, such as faucet 260 to allow water to flow therefrom. Opening faucet 260 activates pressure switch 370, which preferably is set at a set point of 20 psig. Pressure switch 370 activates pump 330, which then pumps out antifreeze A from container C through inlet hose 310, entrance conduit 340, pump 330, exit conduit 360, outlet hose 320, and then via faucet 250 into water line 220 of the dwelling.

When red-colored antifreeze A is seen beginning to drain from open faucet 260 (and all other open faucets, if optionally others have been opened), then exit conduit 360 is closed. Exit conduit 360 may be closed by closing faucet 250 or shut-off valve 362; however, it is preferred to close faucet 260 in order to close exit conduit 360. When faucet 260 (or faucet 250 or shut-off valve 362) is closed, pressure switch 370 will automatically turn off pump 330.

In the preferred method, all other valved water outlets 260 are opened sequentially one at a time. More particularly, one of the other valved outlets is opened until antifreeze A flows therefrom, and then shut, which turns off pump 330. Then, the next one of the other valved outlets is opened (not illustrated), which restarts pump 330 until antifreeze A flows therefrom and then shut, which shuts off pump 330. The opening and shutting is repeated for all remaining valved outlets.

For instance, the preferred method comprises opening a first of all other valved water outlets 260, thereby activating pressure switch 370 to cause the pump 330 to pump antifreeze A through that one valved water outlet 260 and into that branch water line therefor of main water line 230 until antifreeze A flows from that valved water outlet 260. That first other valved water outlet 260 is then closed which deactivates switch 370 and turns off pump 330. Next, the method comprises moving to the next of all other valved water outlets (including flush handles FH for fixtures such as toilets T), opening that valve, such as by holding down flush handle FH of a toilet T, which activates switch 370 and thereby pump 330 to pump antifreeze A into that fixture or valve. The valved water outlet or fixture is then closed, such as by shutting off the kitchen sink faucet or by closing shut-off valve 282 for toilet T, when antifreeze A is visible, such as in the sink bowl or in the toilet bowl, and then switch 370 deactivates and turns off pump 330. Each faucet, fixture, et cetera, is attended to sequentially one at a time; the apparatus 300 remains connected to the original valved water outlet 250 and is not moved throughout the method. It is preferred to achieve the sequence by beginning with the valved water outlet 260 farthest away from original valved water outlet 250 to which apparatus 300 is connected and then moving progressively closer to valved water outlet 250 during the sequence.

Also, in the preferred-method, shut-off valve 284 leading to hot water heater tank WH of the dwelling is to be closed and the gas pilot light or the electricity for keeping the water warm in hot water heater tank WH is to be turned off. However, if desired, the gas pilot light or the electricity for hot water heater tank WH can be turned off, and shut-off valve 284 leading to hot water tank WH left open, and then, antifreeze A is supplied also to hot water heater tank WH preferably as follows.

Shut-off valve 284 leading to hot water heater tank WH of the dwelling is closed and the gas pilot light or the electricity for keeping the water warm in hot water heater tank WH is turned off before the dwelling is to be freeze protected. Then, winterizing proceeds by pumping antifreeze A through valved outlet 250 and into mainline 230 throughout the dwelling as described above, and closing valved outlet 250, so that preferably hot water heater tank WH is attended to last. When the dwelling is protected, drain faucet DF for water heater tank WH is opened followed by the water being drained and faucet DF is left open. Then, antifreeze A is first supplied by opening the hot water line at valved outlet 250 until antifreeze A appears at bottom drain faucet DF of hot water heater tank WH and then outlet 250 and shut-off valve 284 for hot water heater tank WH are closed. Next, shut-off valve 284 is opened, drain faucet DF is opened, and antifreeze A supplied by opening the cold water line at valved outlet 250 until antifreeze A appears at bottom drain faucet DF of hot water heater tank WH followed by closing shut-off valve 284 for hot water heater tank WH and closing drain faucet DF for hot water heater tank WH. Finally, outlet 250, the outlet to which second end 320B is connected, is closed and apparatus 300 disconnected as follows. Disconnect power source, then valve 362 is shut so that second end 320B of outlet hose 320 can then be disconnected from faucet 250 and placed in container C. When shut-off valve 362 is re-opened, any remaining antifreeze A in apparatus 300 will then drain back into container C from second end 320B of outlet hose 320 and/or from first end 310A of inlet hose 310.

Furthermore, it is noted that when it is desired again to use the dwelling and hence drain antifreeze A from main line 230 of the dwelling, all faucets 250 and 260 should be opened. Next, shut-off valve 212 of water supply line 210 should be opened, and water allowed to flow for several minutes, preferably at least 10 minutes, to flush out antifreeze A. Then, all faucets 250 and 260 may be closed.

It will be understood that various details of the present invention may be changed without departing from the scope of the invention. Furthermore, the foregoing description is for the purpose of illustration only, and not for the purpose of limitation—the invention being defined by the claims.

What is claimed is:

1. In combination with a water pipe assemblage of a dwelling, the pipe assemblage having (i) a valved water supply line for supplying water into the dwelling, (ii) a water main line disposed in the dwelling and hydraulically connected to receive water from the water supply line, and (iii) a plurality of valved water outlets hydraulically connected with the water main line, a fluidizing apparatus comprising:

(A) a pump;

(B) an inlet line adapted for providing fluid from a source thereof to the pump;

(C) an outlet line adapted for providing fluid from the pump by way of at least one valved water outlet into the main water line;

(D) a pressure switch in fluid communication with the outlet line; and (E) an air compressor tank containing compressed air and in fluid communication with the pressure switch and the outlet line, and wherein the compressed air from the pressure tank is adapted to activate the pressure switch, upon a change in fluid pressure within the outlet line, and maintain consistent pumping of the fluid by the pump into the main water line, when the valved water supply line is manually closed, the at least one valved water outlet to which the outlet line is connected is manually opened, and at least a first of all the other valved water outlets is manually opened, and the pressure switch is adapted to deactivate the pump when the outlet line is connected to the at least one valved water outlet and fluid flow through the outlet line is stopped by manually closing the at least one valved water outlet such that the compressed air from the pressure tank changes fluid pressure within the outlet line to activate the pressure switch for deactivating the pump.

2. The combination of claim 1, wherein the fluid is selected from the group consisting of antifreeze, cleaner, and sanitizer.

3. The combination of claim 2, wherein the fluid is antifreeze and the fluidizing apparatus is a winterizing apparatus.

4. The combination of claim 1, wherein the inlet line includes:

(A) an inlet hose having a first end and a second end, and wherein the inlet hose first end is adapted to be positioned in the fluid and the fluid is contained in a container; and (B) an entrance conduit having a first end and a second end and a check valve disposed between the entrance conduit first end and the entrance conduit second end, and wherein the entrance conduit second end is connected to the pump, and wherein the inlet hose second end and the entrance conduit first end are connected.

5. The combination of claim 4, wherein an intake manifold connects the inlet hose second end and the entrance conduit first end.

6. The combination of claim 1, wherein the outlet line includes:

(A) an outlet hose having a first end and a second end, and wherein the outlet hose second end is adapted to be connected to the at least one valved water outlet; and (B) an exit conduit having a first end and a second end and a shut-off valve disposed at the exit conduit second end, and wherein the exit conduit first end is connected to the pump, and wherein the outlet hose first end and the exit conduit second end are connected.

7. The combination of claim 6, wherein the outlet hose second end and the at least one valved water outlet are connected by an L-shaped connector.

8. The combination of claim 1, wherein the fluid communication is achieved via a T-connector having a vertical bar with an end leading to the tank and having a horizontal bar with two ends wherein the two ends of the horizontal bar of the T-connector lead to the pressure switch and the exit conduit, respectively.

9. A winterizing apparatus for preventing freezing of water in a water pipe assemblage of a dwelling, the dwelling water pipe assemblage having (i) a valved water supply line for supplying water into the dwelling, (ii) a water main line disposed in the dwelling and hydraulically connected to receive water from the water supply line, and (iii) a plurality of valved water outlets hydraulically connected with the water main line, the apparatus comprising:

(A) an inlet hose having a first end and a second end, and wherein the inlet hose first end is adapted to be positioned in antifreeze contained in a container;

(B) an outlet hose having a first end and a second end, and wherein the outlet hose second end is adapted to be connected to at least one valved water outlet;

(C) a pump;

(D) an entrance conduit having a first end and a second end and a check valve disposed between the entrance conduit first end and the entrance conduit second end, and wherein the entrance conduit second end is connected to the pump;

(E) an intake manifold connecting the inlet hose second end and the entrance conduit first end;

(F) an exit conduit having a first end and a second end and a shut-off valve disposed at the exit conduit second end, and wherein the exit conduit first end is connected to the pump, and wherein the outlet hose first end and the exit conduit second end are connected;

(G) a pressure switch in fluid communication with the exit conduit; and (H) an air compressor tank containing compressed air and in fluid communication with the pressure switch and the exit conduit, and wherein the compressed air from the pressure tank is adapted to activate the pressure switch, upon a change in fluid pressure within the outlet line, and maintain consistent pumping of the antifreeze by the pump from the container of antifreeze into the main water line of the dwelling, and wherein the pressure switch is adapted to deactivate the pump when the outlet hose second end is connected to at least one valved water outlet and fluid flow through the outlet hose is stopped by manual closure of the shut-off valve disposed at the exit conduit second end such that the compressed air from the pressure tank changes fluid pressure within the outlet line to activate the pressure switch for deactivating the pump.

10. A method for providing fluid to a water pipe assemblage of a dwelling, the method comprising:

(A) providing, in combination with a water pipe assemblage of a dwelling, the pipe assemblage having (i) a valved water supply line for supplying water into the dwelling, (ii) a water main line disposed in the dwelling and hydraulically connected to receive water from the water supply line, and (iii) a plurality of valved water outlets hydraulically connected with the water main line, a fluidizing apparatus comprising:

(i) a pump;

(ii) an inlet line adapted for providing fluid from a source thereof to the pump, (iii) an outlet line adapted for providing fluid from the pump by way of at least one valved water outlet into the main water line, (iv) a pressure switch in fluid communication with the outlet line, and (v) an air compressor tank containing compressed air and in fluid communication with the pressure switch and the outlet line, wherein the compressed air from the pressure tank is adapted to activate the pressure switch, upon a change in fluid pressure within the outlet line, and maintain consistent pumping of the fluid by the pump into the main water line, when the valved water supply line is manually closed, when the at least one valved water outlet to which the outlet line is connected is manually opened, and when at least a first of all the other valved water outlets is manually opened, and wherein the pressure switch is adapted to deactivate the pump when the outlet line is connected to the at least one valved water outlet and fluid flow through the outlet line is stopped by manual closure thereof, such that the compressed air from the pressure tank changes fluid pressure within the outlet line to activate the pressure switch for deactivating the pump;

(B) manually shutting off the valved water supply line;

(C) connecting the outlet line to the at least one valved water outlet;

(D) manually opening the at least one valved water outlet to which the outlet line is connected and then manually opening at least the first of all the other valved water outlets to allow water to flow therefrom, thereby allowing the compressed air from the pressure tank to activate the pressure switch, upon a change in fluid pressure within the outlet line, and cause the pump to pump fluid through the at least one valved water outlet and into the main water line until the pumped fluid flows from at least the first of all the other open valved water outlets;

(E) manually closing at least the first of all the other open valved water outlets to activate the pressure switch for deactivating the pump by the compressed air from the pressure tank changing fluid pressure within the outlet line;

(F) manually closing at least one valved of the water outlet to which the outlet line is connected and of the outlet line; and (G) disconnecting the outlet line from the at least one valved water outlet.

11. The method of claim 10, wherein the fluid is selected from the group consisting of antifreeze, cleaner, and sanitizer.

12. The method of claim 11, wherein the fluid is antifreeze and the fluidizing apparatus is a winterizing apparatus and providing fluid to a water pipe assemblage includes preventing freezing of water in the water pipe assemblage.

13. The method of claim 10, wherein the inlet line includes:

(A) an inlet hose having a first end and a second end, and wherein the inlet hose first end is adapted to be positioned in the fluid and the fluid is contained in a container, and (B) an entrance conduit having a first end and a second end and a check valve disposed between the entrance conduit first end and the entrance conduit second end, and wherein the entrance conduit second end is connected to the pump, and wherein the inlet hose second end and the entrance conduit first end are connected.

14. The method of claim 13, wherein an intake manifold connects the inlet hose second end and the entrance conduit first end.

15. The method of claim 10, wherein the outlet line includes:

(A) an outlet hose having a first end and a second end, and wherein the outlet hose second end is adapted to be connected to the at least one valved water outlet, and (B) an exit conduit having a first end and a second end and a shut-off valve disposed at the exit conduit second end, and wherein the exit conduit first end is connected to the pump, and wherein the outlet hose first end and the exit conduit second end are connected.

16. The method of claim 15, wherein the outlet hose second end and the at least one valved water outlet are connected by an L-shaped connector.

17. The method of claim 10, wherein the fluid communication is achieved via a T-connector having a vertical bar with an end leading to the tank and having a horizontal bar with two ends wherein the two ends of the horizontal bar of the T-connector lead to the pressure switch and the exit conduit, respectively.

18. The method of claim 10, wherein the method is sequential in that at least a first of all the other valved water outlets is opened until pumped fluid flows therefrom and then is shut, and then a next of all the other valved water outlets is opened until pumped fluid flows therefrom and then is shut, and sequentially, opening is repeated for each remaining other valved water outlet until pumped fluid flows therefrom and then each is shut.

19. A method for providing fluid to a water pipe assemblage of a dwelling, the method comprising:

(A) providing, in combination with a water pipe assemblage of a dwelling, the pipe assemblage having (i) a valved water supply line for supplying water into the dwelling, (ii) a water main line disposed in the dwelling and hydraulically connected to receive water from the water supply line, and (iii) a plurality of valved water outlets hydraulically connected with the water main line, a fluidizing apparatus comprising:

(i) a pump, (ii) an inlet line adapted for providing fluid from a source thereof to the pump, (iii) an outlet line adapted for providing fluid from the pump by way of at least one valved water outlet into the main water line, (iv) a pressure switch in fluid communication with the outlet line, and (v) an air compressor tank containing compressed air and in fluid communication with the pressure switch and the outlet line, and wherein the compressed air from the pressure tank is adapted to activate the pressure switch, upon a change in fluid pressure within the outlet line, and maintain consistent pumping of the fluid by the pump into the main water line, when the valved water supply line is manually closed, when the at least one valved water outlet to which the outlet line is connected is manually opened, and when at least a first of all the other valved water outlets is manually opened, and wherein the pressure switch is adapted to deactivate the pump when the outlet line is connected to the at least one valved water outlet and fluid flow through the outlet line is stopped by manual closure thereof such that the compressed air from the pressure tank changes fluid pressure within the outlet line to activate the pressure switch for deactivating the pump;

(B) manually shutting off the valved water supply line;

(C) connecting the outlet line to the at least one valved water outlet;

(D) manually opening the at least one valved water outlet to which the outlet line is connected and then manually opening at least a first of all the other valved water outlets to allow water to flow therefrom;

(E) allowing the compressed air from the pressure tank to activate the pressure switch, upon a change in fluid pressure with the outlet line, and cause the pump to pump fluid through the at least one valved water outlet and into the main water line until the pumped fluid flows from the first open of all the other open valved water outlets;

(F) manually closing the first open of all the other valved water outlets to activate the pressure switch for deactivating the pump by the compressed air from the pressure tank changing fluid pressure within the outlet line;

(G) sequentially repeating manual opening and manual closing of steps (E) and (G) with a next of all the other valved water outlets until steps (E) and (G) are accomplished with all the remaining other valved water outlets; and (H) disconnecting the outlet line from the at least one valved water outlet.

20. A method for preventing freezing of water in a water pipe assemblage of a dwelling, the dwelling water pipe assemblage having (i) a valved water supply line for supplying water into the dwelling, (ii) a water main line disposed in the dwelling and hydraulically connected to receive water from the water supply line, and (iii) a plurality of valved water outlets hydraulically connected with the water main line, the method comprising:

(A) providing an apparatus having:

(i) an inlet hose having a first end and a second end, and wherein the inlet hose first end is adapted to be positioned in antifreeze contained in a container;

(ii) an outlet hose having a first end and a second end, and wherein the outlet hose second end is adapted to be connected to at least one valved water outlet;

(iii) a pump;

(iv) an entrance conduit having a first end and a second end and a check valve disposed between the entrance conduit first end and the entrance conduit second end, and wherein the entrance conduit second end is connected to the pump;

(v) an intake manifold connecting the inlet hose second end and the entrance conduit first end;

(vi) an exit conduit having a first end and a second end and a shut-off valve disposed at the exit conduit second end, and wherein the exit conduit first end is connected to the pump, and wherein the outlet hose first end and the exit conduit second end are connected;

(vii) a pressure switch in fluid communication with the exit conduit; and (viii) an air compressor tank containing compressed air and in fluid communication with the pressure switch and the exit conduit, and wherein the compressed air from the pressure tank is adapted to activate the pressure switch, upon a change in fluid pressure within the outlet line, and maintain constant pumping of the antifreeze by the pump from the container of antifreeze into the main water line of the dwelling, and wherein the pressure switch is adapted to deactivate the pump when the outlet hose second end is connected to at least one valved water outlet and fluid flow through the outlet hose is stopped by manual closure of the shut-off valve disposed at the exit conduit second end such that the compressed air from the pressure tank changes fluid pressure within the outlet line to activate the pressure switch for deactivating the pump;

(B) manually shutting off the valved water supply line;

(C) connecting the outlet hose second end to the at least one valved water outlet;

(D) manually opening the at least one valved water outlet and then manually opening all other valved water outlets to allow water to flow therefrom;

(E) allowing the compressed air to activate the pressure switch, upon a change in fluid pressure within the outlet line, and cause the pump to pump antifreeze from the container of antifreeze through the at least one valved water outlet and into the main water line of the dwelling until the antifreeze flows from all the other valved water outlets;

(F) manually closing the shut-off valve disposed in the exit conduit to deactivate the pump;

(G) manually closing the at least one valved water outlet followed by manually closing all the other valved water outlets to activate the pressure switch for deactivating the pump by the compressed air from the pressure tank changing fluid pressure within the outlet line; and (H) disconnecting the outlet hose second end from the at least one valved water outlet.

* * * * *